US009312113B1

(12) United States Patent
Muntean et al.

(10) Patent No.: US 9,312,113 B1
(45) Date of Patent: Apr. 12, 2016

(54) CONTAMINATION-PROOF ION GUIDE FOR MASS SPECTROMETRY

(71) Applicant: Bruker Daltonics, Inc., Billerica, MA (US)

(72) Inventors: Felician Muntean, Danville, CA (US); Stephen Zanon, Campbell, CA (US); Desmond Allen Kaplan, Billerica, MA (US)

( * ) Notice: Subject to any disclaimer, the term of this patent is extended or adjusted under 35 U.S.C. 154(b) by 0 days.

(21) Appl. No.: 14/564,173

(22) Filed: Dec. 9, 2014

(51) Int. Cl.
*H01J 49/26* (2006.01)
*H01J 49/06* (2006.01)

(52) U.S. Cl.
CPC ..... *H01J 49/063* (2013.01)

(58) Field of Classification Search
USPC ..... 250/281, 282, 283
See application file for complete search history.

(56) References Cited

U.S. PATENT DOCUMENTS 8,525,106 B2 9/2013 Muntean
2006/0027745 A1* 2/2006 Rebettge et al. ..... 250/292
2009/0321624 A1* 12/2009 Fang ..... H01J 49/004 250/281
2011/0016700 A1* 1/2011 Egley et al. ..... 29/592.1
2015/0097115 A1* 4/2015 Schwartz ..... 250/283

OTHER PUBLICATIONS

Girard et al., Determination of Quadrupole Charging in MS/MS Instruments, Journal of Chromatography Science, Oct. 2010, 778-779, vol. 48 (9).
Busch, Kenneth L., Ion Burn and the Dirt of Mass Spectrometry, Advanstar Communications, Sep. 1, 2010, http://license.icopyright.net/user/viewFreeUse.act?fuid=MTg0NTU5Njk%3D.
Swingler, D. L., The Use of Slotted Poles in a Quadrupole Mass Filter, International Journal of Mass Spectrometry and Ion Processes, 1983, 225-230, vol. 54.

* cited by examiner

*Primary Examiner* — Nicole Ippolito
(74) *Attorney, Agent, or Firm* — Benoit & Cote, Inc.

(57) ABSTRACT

The invention relates to a radio frequency ion guide construction for use in mass spectrometry that minimizes contamination by allowing ions rejected by the RF confinement field to fly through and away from the ion guide electrodes and preventing them from hitting the sensitive electric potential defining surfaces of the ion guide electrodes. At the entrance end of the ion guide, each electrode of the plurality of electrodes has a front end that is forked or that contains a recessed feature facing an interior of the ion guide. For an electrode that is forked, the teeth of the forked end may have different shapes or tapers, and a conductive mesh may be used to cover a gap between the teeth. Similarly, for an electrode that has a recessed feature, a conductive mesh may cover the recessed feature.

18 Claims, 8 Drawing Sheets

CONTAMINATION-PROOF ION GUIDE FOR MASS SPECTROMETRY

BACKGROUND OF THE INVENTION

1. Field of the Invention

This invention relates to radio frequency (RF) ion guides for use in mass spectrometry.

2. Description of the Related Art

Ion guides are commonly used in a mass spectrometer (MS) to transport ions between the ion source and the mass analyzer and commonly consist of a number of elongate, parallel conductive rods that are placed around a common axis. Various embodiments of ion guides are known in the art. An example of a prior art multipole ion guide is illustrated in FIG. 1. For convenience of description, the ion guide example of FIG. 1 is specific to a quadrupole ion guide. However, embodiments of the invention may be used also in other types of multipoles, such as hexapoles, octopoles, etc. In the ion guide of FIG. 1, ions from an ion source not shown in the figure are transferred to the ion guide 100, which is driven by voltage generators 105 and 110.

As shown in FIG. 1, four conductive rods, constituting the quadrupole ion guide 100, are arranged in two pairs, each pair receiving the same RF signal denoted as V cos(wt), wherein V and w are the magnitude and frequency of the RF signal, respectively. One pair of rods receives the signal at zero phase (+V cos(wt)) while the other receives the signal at a 180 degrees phase shift (−V cos(wt)), whereby the ion guide 100 acts as an ion tube transmitting the ions over a broad range of mass to charge ratios, generally denoted as m/z. The range of m/z ratios has a lower and an upper limit beyond which ions cannot be reliably transmitted anymore. While the lower limit is quite sharp (sometimes called lower mass cut-off), the upper limit is slightly more diffuse.

FIG. 2 schematically shows an example of a quadrupole ion guide Q0 for transporting the ions prior to a triple quadrupole mass analyzer assembly Q1, Q2, Q3 in the wider context of a complete mass spectrometer. The mass spectrometer may be mounted in a housing 200, which is divided in two separate vacuum stages 202A, 202B, and may comprise an EI or CI ion source 204, a lens tube 206 at the exit of the ion source 204 for extracting ions and transmitting them to the quadrupole ion guide Q0, a primary mass filter Q1, a curved quadrupole collision/fragmentation cell Q2 providing a U-turn of the ion path, and a secondary mass filter Q3 in serial alignment between the ion source 204 and an ion detector.

As shown, ion source 204 and ion detector may generally be provided at opposing ends of the ion path in the mass spectrometer. Due to the particular path settings in the example shown, the ion source 204 and the ion detector can be located immediately adjacent to one another, separated only by intermediate walls 208 (dashed lines) bordering the two vacuum stages 202A, 202B. Deviating from the example shown, it would be likewise possible to replace the curved assemblies Q0 and Q2 by straight equivalents, whereby a linear configuration would result.

An ultra-high (turbo) vacuum pump, not shown, may be disposed in the housing 200 to maintain the two vacuum stages 202A, 202B evacuated. Evacuation holes, not shown in FIG. 2, may be provided at different positions of the housing 200. Lens tube 206 and ion source 204 are positioned in a first sealed region of the housing 200 provided by the walls 208 and a sealing ring which engages a cover, both not shown, to provide the vacuum seal.

At the center of the ion path along the quadrupole ion guide Q0, a gas inlet may be provided for introducing an interaction gas, such as helium, nitrogen or methane, into the quadrupole ion guide Q0 which can be configured, for example, like the one described in U.S. Pat. No. 8,525,106 B2 to Muntean.

In the example shown in FIG. 2, the quadrupole ion guide Q0 is curved by 90°. Radio frequency voltages and, as the case maybe, direct current (DC) offset voltages, can be applied to adjacent pole electrodes. The pole electrode profile may be of several different shapes, such as square, circular round, hyperbolically round, circular concave, flat, rectilinear, etc.

Because of the proximity to the source region, ion guides are generally exposed to contamination in the form of deposits on the ion guide electrodes. Deposits can be brought about by either neutral molecules that condense on the electrodes, or by large amounts of ions that are rejected by the ion guide, hit the electrodes as a result thereof and lose the charge so that the underlying neutral substrate molecules condense on the electrodes. A combined effect of the aforementioned may also be that neutral molecules condense on the electrodes and then react with rejected ions that hit the electrodes and decompose into stable solid structures that "grow" on the electrode surfaces, such as carbon deposits originating from hydrocarbon analyte molecules that have decomposed.

FIG. 3 illustrates by way of example a graphical representation of deposits (dashed contours) that have actually formed on the inner surfaces of two quadrupole ion guide electrodes during operation in the laboratory of the inventors. Shown is an entrance end, where ions are received along the central trajectory arrow, of the two pole electrodes that have a substantially square cross section. For the sake of clarity, the other two quadrupole electrodes which would normally be positioned opposite the depicted ones in order to enable radial ion confinement are not shown. The two dashed arrows diverging from the central dashed arrow schematically indicate the path that rejected ions would have taken, in contrast to ions that would have been transmitted. As is evident from this illustration and frequently observed in laboratory practice, the deposits form predominantly at the central parts of the electrode surface.

Such deposits in mass spectrometers are described in the literature, for example, by Girard et al. (Journal of Chromatography Science, 2010 October, 48 (9), 778-779) and Kenneth L. Busch ("Ion Burn and the Dirt of Mass Spectrometry", online publication, Sep. 1, 2010).

The formation of deposits on the ion guide electrodes is undesired, because the deposited layer may be dielectric and charges up when hit by rejected ions. In such a case, the deposits can lead to undesired electric potential barriers which deflect and distort ion motion and deteriorate the MS performance.

A remedy for the above-mentioned deposition problem could be to heat the ion guide electrodes during operation so that they are less prone to accepting contaminating deposits. Another remedy would be to periodically clean the ion guide electrodes in order to restore the MS performance when the deposits have grown too large. The first solution, heating, adds complexity to the mass spectrometer design, both because it requires additional hardware for heating and because it requires adding a heat barrier to prevent the hot ion guide from affecting the performance of the mass analyzer that follows. The second solution, cleaning, is generally not desired at high frequency, because it reduces the uptime of the instrument and is thereby detrimental to the productivity of the MS. Furthermore, it may also create performance problems if disassembly, cleaning, and reassembly are not carried out correctly (for instance by ill-trained staff).

D. L. Swingler, International Journal of Mass Spectrometry and Ion Processes, 54 (1983) 225-230, suggested to provide for longitudinal or transverse slots in the pole electrodes of a quadrupole mass filter. Although such structural modification of the electrodes might mitigate the contamination issue, the electrodes retain material directly at their front ends which are particularly susceptible to ion impingement and hence deposit forming. It can be shown from ion trajectory simulations that the electrode surfaces at the entrance area of an ion guide are exposed to the highest ion current, because most ions rejected by the RF confinement fields (that is, not stably transmitted) will be ejected at this point.

In view of the foregoing, there is a need to provide ion guides that are less susceptible to contamination on the electrode surfaces.

SUMMARY OF THE INVENTION

The disclosure presents an ion guide construction that naturally minimizes contamination by generally allowing rejected ions to fly through and away from the ion guide electrodes and preventing them from hitting the sensitive electric potential defining surfaces of the ion guide electrodes.

In a first aspect, the invention relates to a radio frequency ion guide having a plurality of electrodes arranged about an axis and a radio frequency voltage generator applying radio frequency voltages to the plurality of electrodes for radially confining ions, wherein the ions are received at an entrance end of the ion guide, and further wherein each electrode of the plurality of electrodes has a forked front end which is located at the entrance end of the ion guide.

The forked front end may comprise two or more teeth.

In various embodiments, a conductive mesh may cover an intermediate gap between the teeth and thereby at least partially restore an electric potential defining inwardly facing surface of each electrode.

A thickness of the teeth may decrease in a direction away from the axis, such that the gap obtains substantially a V-profile, for instance.

The teeth may extend along the axis over about one centimeter (from the front end).

In various embodiments, a width of a gap between the teeth may amount to up to half of the total width of the electrode. Further, a width of a gap between the teeth may taper in a direction along the axis.

The front end may be one of bifurcated (two teeth) and further multi-furcated (four or more teeth).

In various embodiments, the plurality of electrodes may comprise four or more rod electrodes, such as six, eight, etc.

In various embodiments, the plurality of electrodes may comprise one of straight (or linear) electrodes and curved electrodes, such as curved by 90° or 180°, for example.

In various embodiments, the assembly may further comprise an ion source, such as an EI or CI source, located upstream of the ion guide so that ions originating therefrom are transmitted to the entrance end, and may yet further comprise a mass analyzer, such as a triple quadrupole mass analyzer, time-of-flight analyzer, Fourier Transform analyzer, etc., located downstream from the ion guide so that ions having traversed the ion guide are further transmitted thereto.

A first portion at the entrance end of each electrode may be materially detached from a subsequent second portion of each electrode.

In various embodiments, the detached portion may be located in a first pressure regime, such as in an ion source, and the subsequent second portion may be located in a second, lower pressure regime, such as in a vacuum stage.

In various embodiments, the radio frequency voltage applied to the detached portion may be different to that applied to the subsequent second portion.

The voltage generator may also be capable of providing direct current voltage(s) to the plurality of electrodes, such as to establish an offset potential at the electrodes or to operate the ion guide as a (narrow) band-pass filter for ions of a limited mass-to-charge ratio range, for instance.

The disclosure also presents an ion guide construction that generally allows rejected ions to impinge on surfaces of the pole electrodes offset from the ion guide axis compared to integral pole electrodes, thereby minimizing any detrimental influence deposits on such surfaces might have on the electric fields in the interior of the ion guide.

In a second aspect, the invention relates to a radio frequency ion guide having a plurality of electrodes arranged about an axis and a radio frequency voltage generator applying radio frequency voltages to the plurality of electrodes for radially confining ions, wherein the ions are received at an entrance end of the ion guide, and further wherein each electrode of the plurality of electrodes has a recessed feature at a surface facing an interior of the ion guide, the recessed feature being located at the entrance end of the ion guide.

In various embodiments, the assembly further comprises a conductive mesh which may cover at least a portion of the recessed feature and thereby at least partially restores the electric potential defining surface facing the interior of the ion guide of each electrode.

The recessed feature may comprise an elongate groove or pocket.

BRIEF DESCRIPTION OF THE DRAWINGS

The invention can be better understood by referring to the following figures. The components in the figures are not necessarily to scale, emphasis instead being placed upon illustrating the principles of the invention (often schematically).

DETAILED DESCRIPTION

While the invention has been shown and described with reference to a number of embodiments thereof, it will be recognized by those skilled in the art that various changes in form and detail may be made herein without departing from the scope of the invention as defined by the appended claims.

Radio frequency ion guides can be operated with very large transmission efficiency, close to 100% for a wide mass range.

Figure 3:
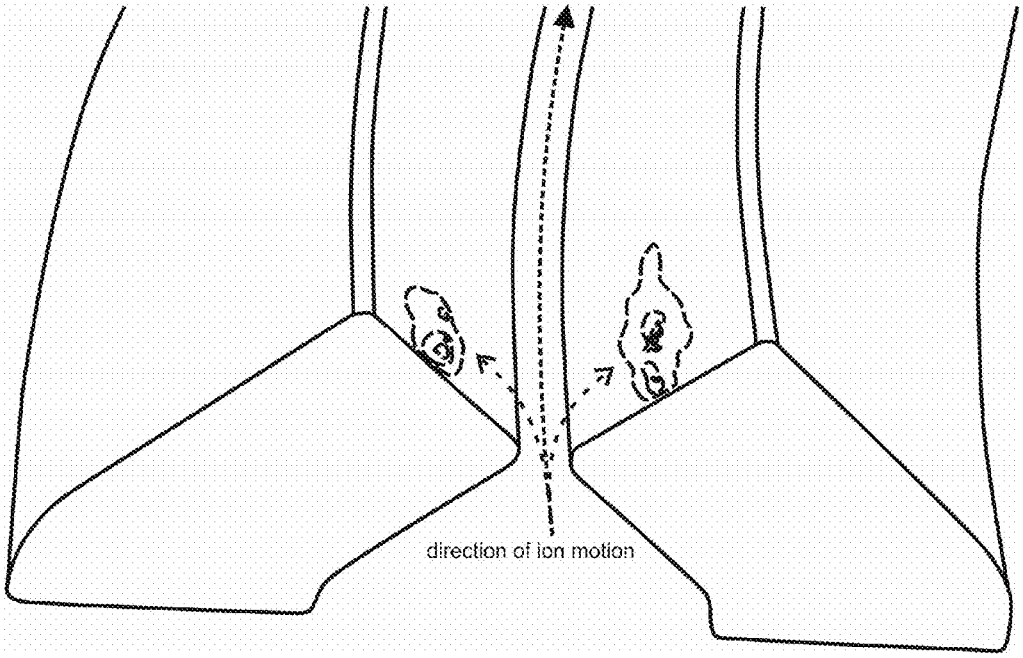
FIG. 3 shows a graphical representation of pole electrodes featuring stains on their inwardly facing surfaces.

Nevertheless, the mass range is limited at the low end (low mass cut-off) such that all ions having a mass to charge ratio m/z lower than this cut-off value will not be transmitted and end up hitting the ion guide electrodes (if they do not pass through the gaps between the electrodes). Ion trajectory simulations show that most of these ions are rejected and hit the entrance section of the ion guide, which is also supported by the observation that most of ion guide contamination occurs in the entrance region of the ion guide, as shown in FIG. 3.

One idea of this invention, according to a first aspect, is to open up a central section of the electrode structure at the ion guide entrance such that most of the rejected ions can escape through and away from the electrodes. In this manner, the rejected ions can be pumped away without running the risk of them hitting a part of the sensitive, electric potential defining electrode surfaces which face the interior and/or axis of the ion guide. The open section is subject to a size restriction in that the electric fields in the central part of the ion guide that are responsible for the radial confinement of ions meeting the stability criteria must not be significantly perturbed. When observing these requirements, the ion transmission of the useful ions, or ions of interest, is not significantly affected.

Figure 4:
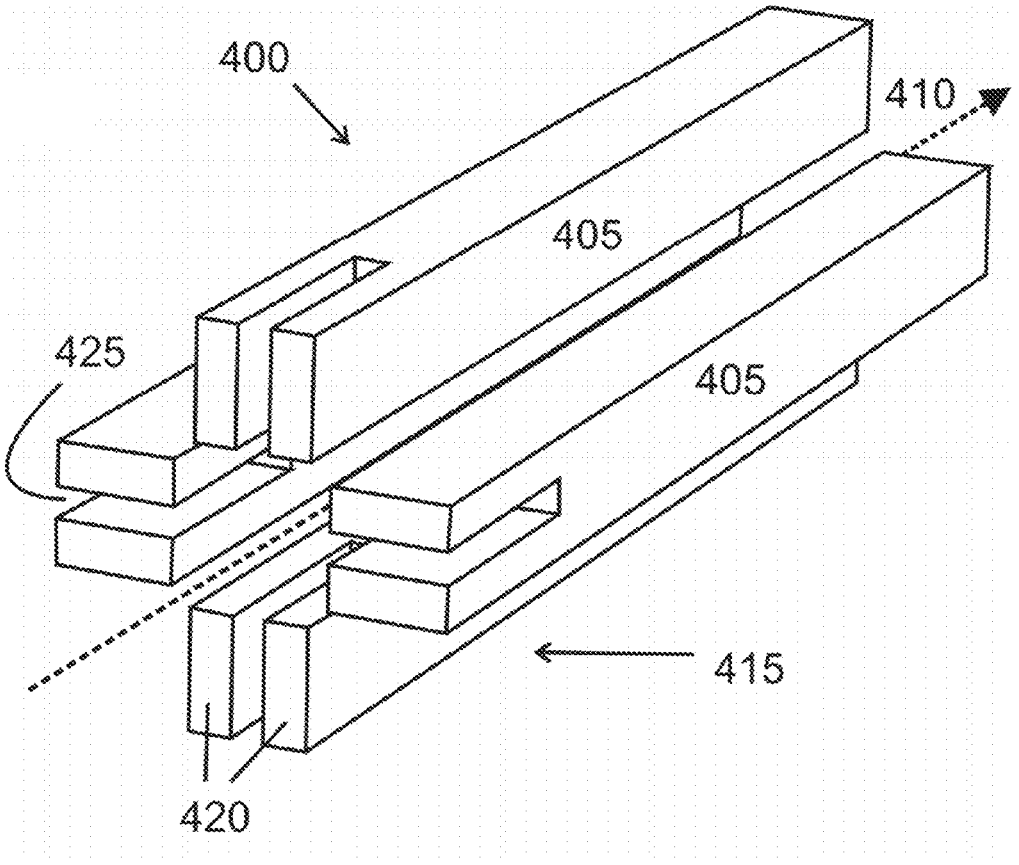
FIGS. 4 and 4A to 4H show exemplary embodiments of a radio frequency ion guide and corresponding electrodes according to a first aspect of the disclosure.

A first exemplary way of doing it is presented in FIG. 4 which shows a quadrupole arrangement 400 having four pole electrodes 405 positioned about a central axis 410. The pole electrodes 405 in this example are straight elongate and basically have a square cross section such that an inner width in between the electrodes 405 also has a substantially square profile.

At an entrance end 415, as shown in FIG. 4, each pole electrode 405 has two teeth 420 and an intermediate gap 425 between the two teeth 420 (resembling an open longitudinal slit). As this shape is similar to that of a tuning fork, this embodiment will be referred to as a forked entrance end configuration. The teeth 420 are worked (for instance, cut) into the bodies of the otherwise integral pole electrodes 405 such that they each provide a direct path from the central axis 410 in between the electrodes 405 to the outside. Since the four pole electrodes 405 can be thought of as being arranged about the central axis 410 in two opposing pairs, this means that the two gaps 425 of two opposing electrodes 405 are substantially aligned in parallel with a first plane that contains the central axis 410 while the gaps 425 of the respective other two opposing electrodes 405 are likewise substantially aligned in parallel with a second plane containing the central axis 410 that is at an angle with respect to the first plane, namely oriented perpendicularly in this case.

Figure 1:
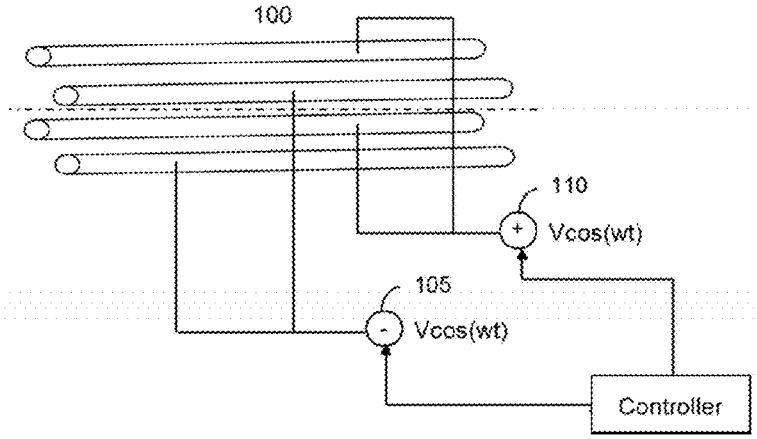
FIG. 1 shows an exemplary implementation of a linear quadrupole ion guide.

As becomes apparent from the illustration of FIG. 4, during operation of an ion guide, ions approach the ion guide 400 from the side that faces the forked entrance end 415. Radio frequency voltages are applied to the four pole electrodes 405 in a conventional manner, such as explained in conjunction with FIG. 1 (offset DC voltages may be added where appropriate), whereby ions meeting the stability criteria of the RF fields created thereby will be accepted by, and transmitted through, the ion guide 400 while ions whose mass to charge ratio m/z does not fall into the stability interval will be rejected. The trajectory of ions to be rejected will become unstable quite rapidly when trying to enter the ion guide 400 and will diverge from the generally central ion path of the stable ions. However, when moving in a radial direction, instead of hitting one of the pole electrode surfaces facing the interior and/or axis of the ion guide 400 which would have been the almost unavoidable result with a conventional ion guide, the unstable ions have a very high chance of passing radially outward through one of the intermediate gaps 425 between the teeth 420 at the entrance end 415 of each pole electrode 405 without running the risk of impinging on an electrode surface and thereby giving rise to contamination problems. And even if some ions hit a part of the remaining electrode surface, by using a configuration as depicted in FIG. 4, it is much more likely that this happens at one of the inner side walls of the intermediate gaps 425 which, however, do not directly face the interior and/or axis of the ion guide 400. If such impingement on the gap walls led to a forming of deposits over time, it would not detrimentally affect the overall performance of the ion guide 400, at least not for a considerable period of time.

Figure 4A:
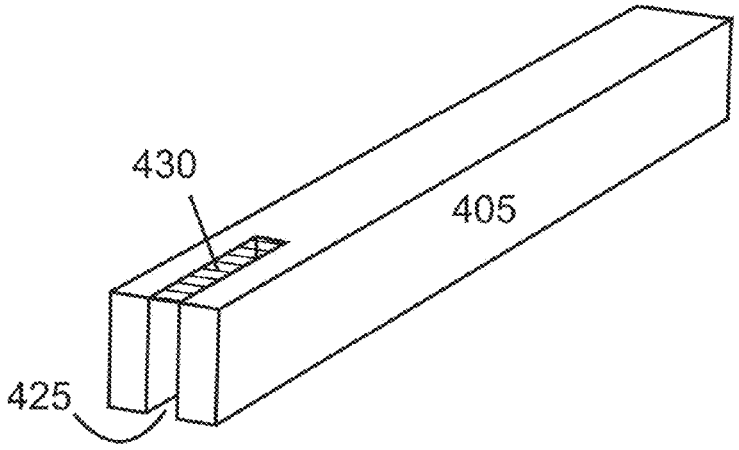

A variation of the embodiment shown in FIG. 4 is shown in FIG. 4A, which depicts a single square pole electrode 405 with a forked entrance end. In this example, the gap 425 between the teeth is covered with an electrically conductive mesh 430, such as an array of parallel fine metallic filaments, which bridges the gap 425. Since the mesh 430 is conductive, it can restore at least a part of the electric potential defining surface of the pole electrode 405 that has been distorted from an integral shape by removing the material of the open longitudinal slit at the entrance end. In so doing, the perturbation of the electric field at the center of the ion guide can be further reduced while still leaving enough aperture area between the thin filaments for ions being rejected from the RF confinement fields to pass through. It is to be understood that the mesh 430 (at least) covers the gap at the side facing the interior and/or axis of the ion guide. In the illustration of FIG. 4A this means that the pole electrode would take the place of the lower one from the assembly in FIG. 4.

Figure 4B:
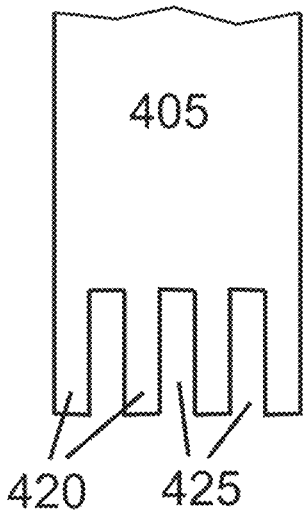

FIG. 4 illustrates an example where the RF ion guide 400 comprises pole electrodes 405 having an entrance end 415 with two teeth 420 and one intermediate gap 425. However, this concept can be extended to pole electrodes having more than two teeth, such as four teeth with three intermediate gaps ("multi-furcated"), as in the example of FIG. 4B where the line of sight is perpendicular to the longitudinal extension of the pole electrode 405. Here, the teeth 420 are displayed with homogeneous thickness, but the underlying principle would not be impaired if the thickness of the teeth would be inhomogeneous. For example, the central teeth could be made thinner than the outer two teeth.

Figure 4C:
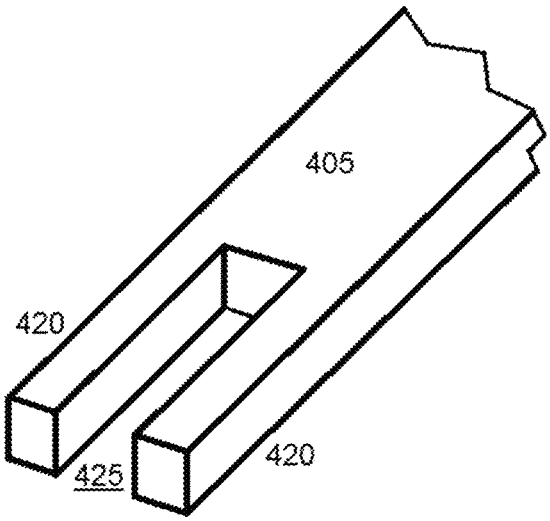

The square electrode profile of FIG. 4 has likewise been shown by way of example. A person skilled in the art will acknowledge that the RF confinement fields inside the ion guide are determined by the conductive surface shape of the electrodes facing the interior and/or axis of the ion guide. Consequently, it is possible to make the electrodes thinner or flatter, as exemplified in FIG. 4C for one electrode 405.

Figure 2:
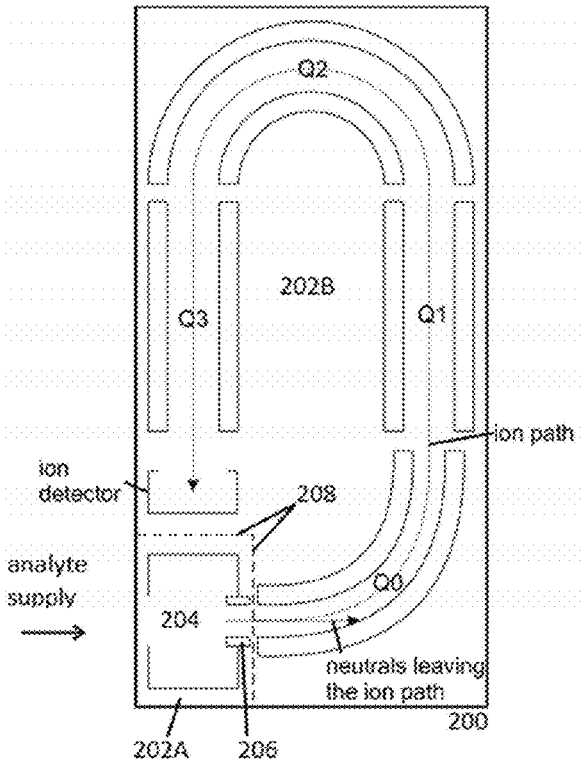
FIG. 2 shows an exemplary implementation of a triple quadrupole mass spectrometer including two radio frequency ion guides.
Figure 4D:
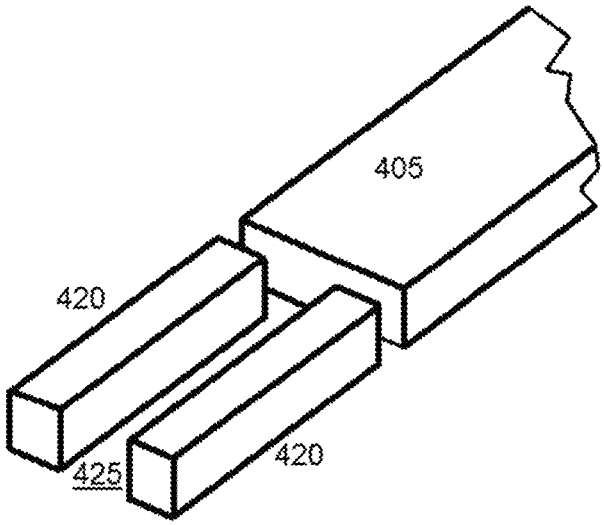

Other embodiments include the teeth of the forked front end of the pole electrodes being materially detached from the remaining portion of the pole electrodes, as shown in FIG. 4D. This entails greater flexibility and therefore versatility. For example, the detached entrance end can be heated to further reduce the propensity of deposit forming on the electrode surface without running the risk of stray heat being transferred to the other parts of the ion guide assembly. Further, the split ion guide can be employed to bridge a pressure differential interface where the forked entrance region is positioned in a first pressure regime, such as in the ion source, and the remaining portion is placed in a second lower pressure regime, such as in a subsequent vacuum stage. The detached configuration also opens up the possibility of supplying different RF voltages to the entrance end and the subsequent portions of the ion guide. Referring to FIG. 2, for example, the detached portion could take the position and function of the element 206, that is, extracting ions from the ion source, while the remaining portion of the ion guide could have a curved shape, such as shown for element Q0.

Figure 4E:
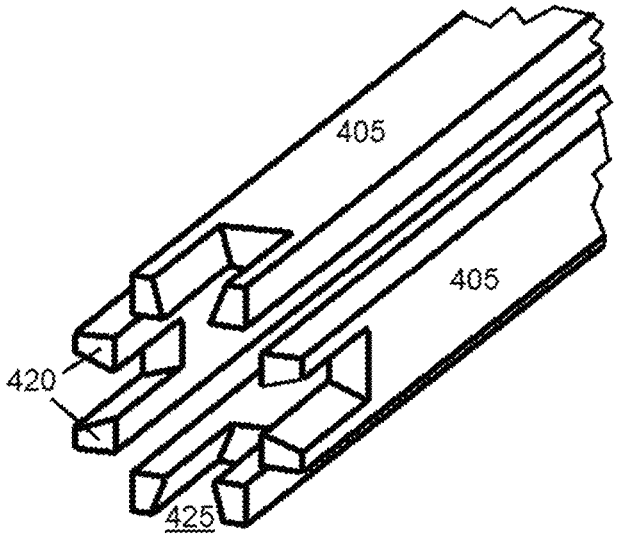

Yet further embodiments include the teeth of the forked front end having a tapering side wall such that a gap or slit width is small at the side facing the interior and/or axis of the ion guide and wider compared thereto at the outside, as shown in FIG. 4E. The gap can be said to have substantially a V-profile. This configuration may prove advantageous when pumping or evacuation requirements are high so that gas flowing into the ion guide from some upstream high pressure ion source, such as an electron ionization source or chemical ionization source, has to be pumped out effectively and rapidly. The slanted, tapering gap walls might also further mitigate any contamination problems, because if ions pass through the slit opening between the teeth and finally impinge on a gap side wall, this side wall will be inclined away from the center of the ion guide providing some screening effect and thereby minimizing any influence deposits could have on the RF confinement fields established between the pole electrodes.

Figure 4F:
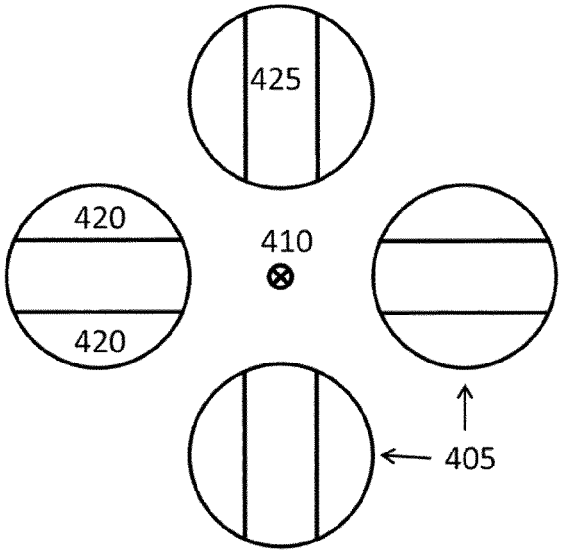

It will be acknowledged further by a practitioner in the field that the square profile of the rods 405 in the previous figures is shown merely by way of example. It is possible to implement features according to the invention also in pole electrodes of other configuration, for instance circular round (as shown in the front view of the entrance end in FIG. 4F, as an approaching ion would encounter it), hyperbolically round, etc. The example embodiments of FIGS. 4 to 4E are not to be considered restrictive in this regard.

Figure 4G:
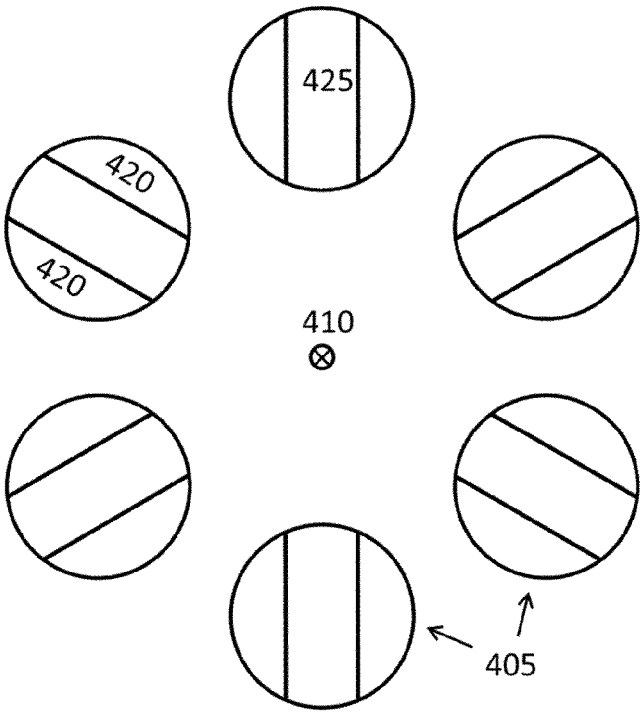

Moreover, FIG. 4 illustrates an example where the RF ion guide 400 comprises four pole electrodes 405. The concept can be extended, however, to RF ion guides having more than four pole electrodes, such as six pole electrodes, as shown in the front view of the entrance end in FIG. 4G, or even more.

Figure 4H:
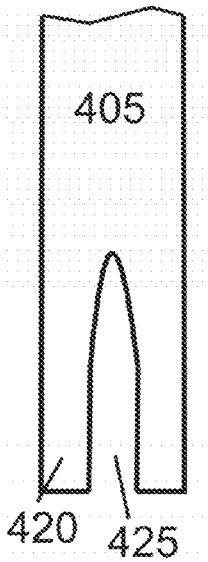

The teeth and/or gaps generally can have straight or (slightly) rounded edges. The wealth of usable shapes is generally not restricted. It is further possible to provide for the gap width to taper in a direction along the axis of the ion guide, as illustrated by way of example in FIG. 4H. In so doing, the transition from a slit-containing electrode portion to a whole electrode portion can be made more smoothly, which may be beneficial for the continuity of the electric fields between the pole electrodes.

Figure 5:
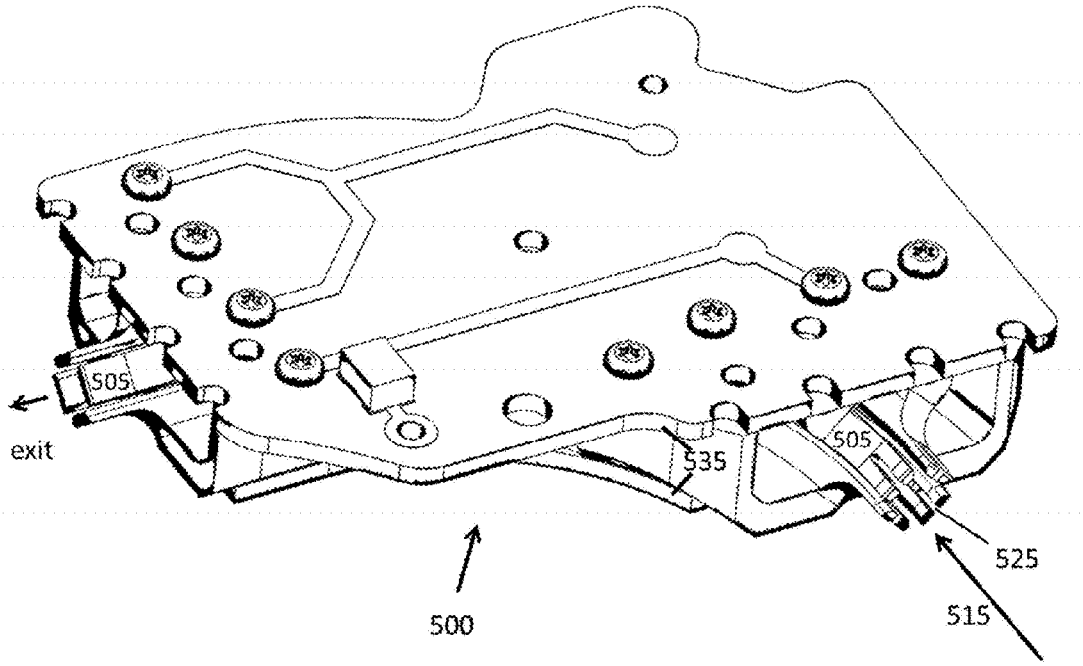
FIG. 5 shows an exemplary embodiment of a curved radio frequency ion guide.

FIG. 5 shows an implementation of an RF ion guide 500 curved by about 90°. The four electrodes 505 generally have almost quadratic cross section (not visible) along most parts of their extension, however are asymmetrically tapered or recessed to render thin and flat end sections at entrance 515 and exit ends of the ion guide 500. In so doing, a capacitive mass of the flat end sections of the electrodes 505, which contributes to a magnitude of a capacitive coupling to pole electrodes of an adjacent RF component (not shown), for instance, can be reduced. The electrodes 505 show the forked front end design at the entrance end 515 with gaps 525 as has been described above, and are mounted between two plate-shaped, non-conductive substrates 535 in a sandwich-like arrangement in the example displayed. With this rather closed design, the ion guide assembly 500 can be used as a collision or reaction cell which is maintained at a higher pressure compared to its surroundings and supplied with suitable neutral or reactive gas.

Figure 6:
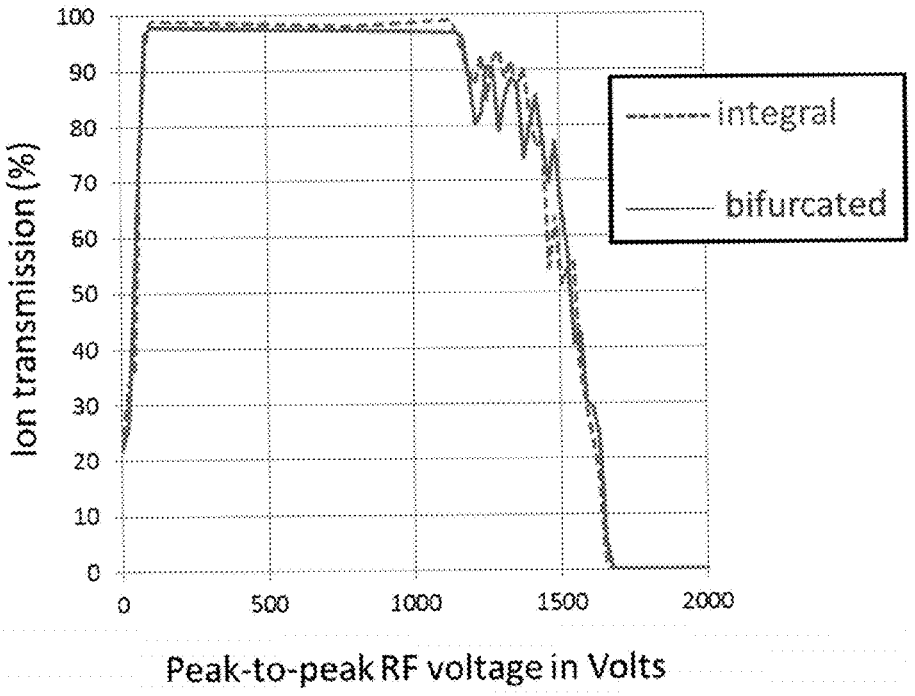
FIG. 6 shows exemplary ion transmission curves obtained via computer simulation.

Ion trajectory simulations using the tool SIMION™ show that transmission of useful ions is largely unaffected by cutting out these open longitudinal slits at the entrance end of the ion guide as shown in FIGS. 4 and 5, so that it is largely comparable between regular integral ion guide electrodes and forked ion guide electrodes. An example of simulated transmission curves for pole electrodes having a square profile is shown in FIG. 6, with one set of electrodes being bifurcated or forked at the entrance end, such as in FIG. 4, while the comparison set is integral. The underlying simulation parameters comprehensible to a practitioner in the field are (concisely): inner radius $r_0$=3 mm; rod width=3.5 mm; rod length=50 mm long; gap width=⅓ $r_0$; gap length=3$r_0$; test ion m/z=264u; ion average kinetic energy=5 eV; ion energy distribution FWHM width=1 eV; ion beam diameter upon entry=$r_0$/2; ion beam divergence=15 degrees; 48 trajectories per RF phase; 8 phases in total=384 ions per RF voltage data point.

As can be seen, by using the forked entrance end the transmission rate is not significantly impaired compared to integral square electrodes. This can be explained by the fact that, at the initial part of the ion guide, the useful ions travel close to the center, or in other words close to the axis, where the electric fields are largely unaffected by the cut-outs through the electrodes. Electric field calculations with the SIMION™ program further show that the electric equi-potential lines are largely consistent with a hyperbolic field and unperturbed at the center of the ion guide and only affected close to the electrodes which is, however, not crucial for the overall performance.

Simulated curves of ion transmission for other embodiments of the modified ion guide electrodes show a similar good match between integral pole electrode and modified pole electrode, and are not shown here for the sake of conciseness.

With the aforementioned modification of the ion guide electrodes, it becomes possible to significantly prolong the uptime of the correspondingly configured ion guide without the need to clean the electrodes at high frequency or heat the electrodes during operation.

The width of the central gaps can be up to substantially half of the effective electrode surface width facing the interior and/or axis of the ion guide. Even with such pronounced modification compared to an integral electrode, the ion transmission remains largely unaffected, less than 5%.

A preferred longitudinal dimension of the gaps and/or teeth would be about one centimeter from the electrode front end and is expected to vary, that is, being longer or shorter, depending in particular on the RF voltage frequency and the axial energy of the ion beam. In some instances, it might be possible to extend the longitudinal dimension to more than one centimeter.

Figure 7:
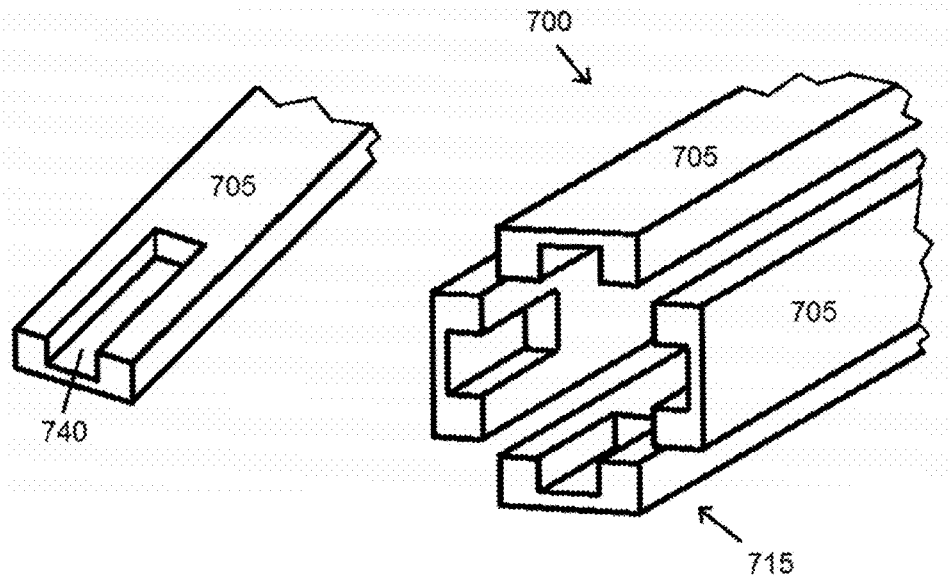
FIG. 7 shows an exemplary embodiment of a radio frequency ion guide and the corresponding electrode design according to a second aspect of the disclosure.

According to another aspect of the invention, as evident from FIG. 7 (single electrode to the left, four electrode assembly to the right), the adverse effects of deposit forming at the entrance region 715 of a radio frequency ion guide 700 can be mitigated by providing a recessed feature, such as a cut-out longitudinal groove or pocket 740, at the surface of the ion guide electrode 705 facing the interior and/or axis of the ion guide 700. In so doing, an electrode surface being offset from the interior and/or axis of the ion guide compared to an integral pole electrode is created. Ions rejected by the RF confinement fields upon entering the ion guide do not have the possibility to pass through the pole electrode 705 anymore and will most likely impinge on an electrode surface, but since the surface (within the groove or pocket) will be further distanced from the axis of the ion guide, it will take a considerably longer period of time before any detrimental influence of a deposit potentially formed on the offset surface on the RF confinement fields within the cell becomes detectable.

The variant with the recessed feature may be advantageous when there are particularly high requirements on pressure control, because the pole electrodes may be used as gas-tight elements and this configuration could simplify the establishing of a regulated pressure level in the channel between the electrodes.

Variations discussed above for the longitudinal end slit embodiments may also be used with the recessed feature embodiments. It is likewise possible, for example, to cover the recessed feature with a conductive mesh (in analogy to FIG. 4A) in order to partially restore the electric potential defining surface. Further, the electrodes can take a variety of shapes and profiles, such as round, as has been explained with reference to the other preceding figures.

The invention has been described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

The invention claimed is:

1. A radio frequency ion guide having a plurality of electrodes arranged about an axis and a radio frequency voltage generator applying radio frequency voltages to the plurality of electrodes for radially confining ions, wherein the ions are received at an entrance end of the ion guide, and further wherein each electrode of the plurality of electrodes has a forked front end which is located at the entrance end of the ion guide.

2. The ion guide of claim 1, wherein the forked front end comprises at least two teeth.

3. The ion guide of claim 2, further comprising a conductive mesh which covers an intermediate gap between the teeth and thereby at least partially restores an electric potential defining inwardly facing surface of each electrode.

4. The ion guide of claim 2, wherein a thickness of the teeth decreases in a direction away from the axis.

5. The ion guide of claim 2, wherein the teeth extend along the axis over about one centimeter.

6. The ion guide of claim 2, wherein a width of a gap between the teeth amounts to up to half of the total width of the electrode.

7. The ion guide of claim 2, wherein a width of a gap between the teeth tapers in a direction along the axis.

8. The ion guide of claim 1, wherein the front end is one of bifurcated and multi-furcated.

9. The ion guide of claim 1, wherein the plurality of electrodes comprises at least four rod electrodes.

10. The ion guide of claim 1, wherein the plurality of electrodes comprises one of straight electrodes and curved electrodes.

11. The ion guide of claim 1, further comprising an ion source located upstream of the ion guide so that ions originating therefrom are transmitted to the entrance end, and yet further comprising a mass analyzer located downstream from the ion guide so that ions having traversed the ion guide are further transmitted thereto.

12. The ion guide of claim 1, wherein a first portion at the entrance end of each electrode is materially detached from a subsequent second portion of each electrode.

13. The ion guide of claim 12, wherein the detached portion is located in a first pressure regime and the subsequent second portion is located in a second lower pressure regime.

14. The ion guide of claim 12, wherein the radio frequency voltage applied to the detached portion is different to that applied to the subsequent second portion.

15. The ion guide of claim 1, wherein the voltage generator is also capable of providing direct current voltage(s) to the plurality of electrodes.

16. A radio frequency ion guide having a plurality of electrodes arranged about an axis and a radio frequency voltage generator applying radio frequency voltages to the plurality of electrodes for radially confining ions, wherein the ions are received at an entrance end of the ion guide, and further wherein each electrode of the plurality of electrodes has a recessed feature at a surface facing an interior of the ion guide, the recessed feature being located at the entrance end of the ion guide, wherein the recessed feature is located at, and symmetrically around, a central portion of the electrodes.

17. The ion guide of claim 16, wherein the recessed feature comprises an elongate groove or pocket.

18. A radio frequency ion guide having a plurality of electrodes arranged about an axis and a radio frequency voltage generator applying radio frequency voltages to the plurality of electrodes for radially confining ions, wherein the ions are received at an entrance end of the ion guide, and further wherein each electrode of the plurality of electrodes has a recessed feature at a surface facing an interior of the ion guide, the recessed feature being located at the entrance end of the ion guide, further comprising a conductive mesh which covers at least a portion of the recessed feature and thereby at least partially restores the electric potential defining surface facing the interior of the ion guide of each electrode.

* * * * *